US011905630B2

(12) United States Patent
Kalantari et al.

(10) Patent No.: US 11,905,630 B2
(45) Date of Patent: Feb. 20, 2024

(54) FIRE-RESISTANT DOUBLE-FACED FABRIC OF KNITTED CONSTRUCTION

(71) Applicant: JESS BLACK INC., Calmar (CA)

(72) Inventors: Mahsa Kalantari, Edmonton (CA); Patricia Dolez, Edmonton (CA); Jessica Buchinski, Calmar (CA)

( * ) Notice: Subject to any disclaimer, the term of this patent is extended or adjusted under 35 U.S.C. 154(b) by 132 days.

(21) Appl. No.: 17/432,857

(22) PCT Filed: Feb. 21, 2020

(86) PCT No.: PCT/CA2020/050227

§ 371 (c)(1),
(2) Date: Aug. 20, 2021

(87) PCT Pub. No.: WO2020/168437

PCT Pub. Date: Aug. 27, 2020

(65) Prior Publication Data

US 2022/0162782 A1 May 26, 2022

Related U.S. Application Data

(60) Provisional application No. 62/809,420, filed on Feb. 22, 2019.

(51) Int. Cl.
*D04B 1/12* (2006.01)

(52) U.S. Cl.
CPC ..... *D04B 1/123* (2013.01); *D10B 2201/24* (2013.01); *D10B 2401/04* (2013.01); *D10B 2403/0114* (2013.01); *D10B 2403/023* (2013.01)

(58) Field of Classification Search
CPC ... D04B 1/14; D04B 1/16; D04B 1/18; D04B 1/123; D10B 2201/24; D10B 2401/04; D10B 2403/023; D10B 2403/0114
See application file for complete search history.

(56) References Cited

U.S. PATENT DOCUMENTS 4,067,210 A * 1/1978 Arons ..... D04B 21/14 139/420 R
5,221,572 A 6/1993 Meunier
(Continued)

FOREIGN PATENT DOCUMENTS

CA 2174481 10/1997
CN 202865470 4/2013
(Continued)

*Primary Examiner* — Danny Worrell
(74) *Attorney, Agent, or Firm* — Bennett Jones LLP

(57) ABSTRACT

A double-faced fabric of knitted construction has a first layer and a second layer. The first layer forms a first outward-facing surface of the fabric, which includes a first yarn that includes first inherently fire-resistant fibers and optionally first elastane fibers. The second layer forms a second outward-facing surface of the fabric, which includes a second yarn that includes second FR viscose fibers and optionally second elastane fibers, other cellulosic-derived fiber, synthetic fire-resistant fiber, antibacterial fiber or combination of such. The first layer and the second layer are attached to each other by interlocking relationship between the first yarn and the second yarn. The first outward-facing surface and the second outward-facing surface of the fabric may used for a garment's outer surface and the inner surface, respectively.

18 Claims, 2 Drawing Sheets

(56) References Cited

U.S. PATENT DOCUMENTS 5,399,418 A * 3/1995 Hartmanns ..... B64G 6/00 442/205
5,468,545 A 11/1995 Fleming et al.
5,589,245 A * 12/1996 Roell ..... D03D 27/10 428/920
5,651,847 A * 7/1997 Loeffler ..... D04B 1/16 66/196
5,727,401 A 3/1998 Statham
5,766,746 A 6/1998 Kampl et al.
5,965,223 A * 10/1999 Andrews ..... D02G 3/442 428/36.1
5,981,407 A 11/1999 Matsumoto et al.
6,287,686 B1 9/2001 Huang et al.
6,764,971 B2 7/2004 Kelly et al.
6,800,367 B2 10/2004 Hanyon et al.
6,840,288 B2 1/2005 Zhu et al.
6,974,785 B1 * 12/2005 Barbeau ..... D03D 15/513 428/920
RE40,314 E * 5/2008 Rock ..... D04B 1/04 428/920
7,473,659 B2 1/2009 Sytz
7,546,853 B2 6/2009 Rock et al.
7,575,783 B2 8/2009 Hilleary et al.
7,659,217 B2 2/2010 Narayanan et al.
8,133,584 B2 3/2012 Zhu
8,209,785 B2 7/2012 Underwood et al.
8,501,639 B2 8/2013 Monfalcone, III et al.
8,536,076 B1 * 9/2013 Byles ..... D04B 1/123 428/920
8,732,863 B2 5/2014 Hines et al.
9,034,777 B2 5/2015 Hines et al.
9,169,582 B2 10/2015 Zhu
9,212,434 B2 12/2015 Ulrich et al.
9,364,694 B2 6/2016 Underwood et al.
9,386,816 B2 7/2016 Underwood et al.
9,499,936 B2 11/2016 Havird et al.
9,630,031 B2 4/2017 Thatcher
9,642,471 B2 5/2017 Curós Santaeularia et al.
9,683,315 B2 6/2017 Schmitt et al.
9,745,674 B2 8/2017 Hines et al.
9,765,454 B2 9/2017 Tutterow et al.
9,920,474 B2 3/2018 Bonner et al.
10,030,326 B2 7/2018 Hines, Jr. et al.
10,774,451 B2 * 9/2020 Stanhope ..... D04B 1/123
2003/0148689 A1 8/2003 Lapierre
2004/0029473 A1 2/2004 McKee et al.
2004/0235383 A1 11/2004 Perry et al.
2005/0025962 A1 2/2005 Zhu et al.
2005/0025963 A1 2/2005 Zhu
2006/0116043 A1 6/2006 Hope et al.
2006/0264136 A1 11/2006 Chiantese
2007/0232176 A1 10/2007 Cashin et al.
2007/0249251 A1 10/2007 Sytz
2008/0076312 A1 3/2008 Gehring
2008/0124993 A1 5/2008 Brady
2009/0019624 A1 1/2009 Birk et al.
2009/0075047 A1 3/2009 Masuda et al.
2009/0176429 A1 7/2009 Chang et al.
2009/0298370 A1 12/2009 Rock
2011/0009022 A1 1/2011 Schoots et al.
2011/0104466 A1 5/2011 Atkinson
2012/0042442 A1 2/2012 Takahashi et al.
2012/0177919 A1 7/2012 Kroner
2012/0270456 A1 10/2012 Gstettner et al.
2013/0008554 A1 1/2013 Fisher et al.
2013/0065470 A1 3/2013 Rock et al.
2013/0101781 A1 4/2013 Lee et al.
2013/0267140 A1 10/2013 Gstettner et al.
2014/0187113 A1 7/2014 Hines, Jr. et al.
2014/0308505 A1 10/2014 Schmitt
2015/0252500 A1 9/2015 Labsch et al.
2015/0322598 A1 11/2015 Stanhope et al.
2016/0201236 A1 7/2016 Matsumoto et al.
2016/0249685 A1 9/2016 Blasi
2017/0175302 A1 6/2017 Habicht et al.
2017/0292210 A1 10/2017 Iwashita
2018/0057973 A1 3/2018 Yang
2021/0047761 A1 * 2/2021 Mayes ..... D04B 1/14
2021/0102315 A1 * 4/2021 Ringo, Jr. ..... D02G 3/443
2021/0292936 A1 * 9/2021 Ringo, Jr. ..... D06M 11/79
2022/0162782 A1 * 5/2022 Kalantari ..... D04B 1/123
2022/0389627 A1 * 12/2022 Ringo, Jr. ..... D02G 3/443

FOREIGN PATENT DOCUMENTS

DE 20006448 6/2000
EP 0976335 A2 2/2000
EP 1880620 1/2008
EP 1367913 2/2008
EP 1754812 4/2010
EP 2479323 7/2012
EP 2738294 4/2014
EP 2484823 4/2017
GB 2152542 8/1985
JP 2008208509 9/2008
JP 2016044386 4/2016
JP 2016113725 6/2016
WO 2000000686 1/2000
WO 2006043958 4/2006
WO 2006008900 5/2008
WO 2012137556 10/2012
WO 2014107750 7/2014
WO 2009101930 8/2014
WO 2013047431 3/2015
WO 2016114984 7/2016
WO 2016178662 11/2016
WO 2016194766 12/2016
WO 2017070529 4/2017
WO 2017084061 5/2017
WO 2018053990 3/2018

* cited by examiner

FIRE-RESISTANT DOUBLE-FACED FABRIC OF KNITTED CONSTRUCTION

CROSS-REFERENCE TO RELATED APPLICATION

This application claims priority to and the benefit of U.S. provisional patent application Ser. No. 62/809,420 filed on Feb. 22, 2019, the entire contents of which are incorporated herein by reference.

FIELD OF THE INVENTION

The present invention relates to the field of textiles, and more particularly to a fire-resistant yarn and fabric produced from such yarn, which may be suitable for use in industrial workwear or activewear.

BACKGROUND OF THE INVENTION

Workers at hazardous jobsites (e.g., oil and gas wellsites, construction sites, laboratories, and factories) require industrial workwear to protect them against heat and fire, UV radiation, and other environmental conditions. Workwear is conventionally made of fabrics that may be somewhat heavy, coarse-textured, inelastic, unbreathable, non-insulating and/or aesthetically unpleasing. This results in the workwear being suboptimal in comfort, fitment, freedom of movement, and/or aesthetics, which has a negative effect on worker performance and morale. Also, workwear is often worn while the worker performs intense physical activity, and is often unlaundered for extended periods of time when workers are in remote locations. Such usage makes the workwear a good habitat for bacterial growth, which can be malodorous and present health hazards for the worker.

Fabrics can be made fire-resistant by known techniques. One technique involves applying a fire-resistant treatment to the fabric, but this may negatively affect the fabric handle (i.e., the feel to the touch of the fabric). Another technique involves incorporating fire-resistant additives in the material of the constituent fibers of the fabric, prior to or at the spinning stage of fiber production such that the additive is permanently associated with the fibers. Lensing™ FR viscose is an example. Still another technique involves producing the constituent fibers of the fabric from inherently fire-resistant fibers, such as fibers made from aramid polymers or copolymers. Kevlar™, Nomex™, and Kermel™ are examples.

In recent years, activewear (i.e., clothing intended for use in physical exercise, and in particular yoga) has become popular as casual clothing. Such activewear may be made with fabrics that are soft and smooth to the touch, stretchy, and form-fitting. It would be desirable if such attributes could be brought to fabrics used for industrial workwear, while maintaining some degree of the fire-resistance.

The prior art includes examples of core spun yarns having core strands made of Lycra™ or Spandex™ fibers, wrapped by staple strands of fire-resistant materials including aramid or fire-resistant viscose: see Chinese utility model CN202865470U to Ge (2013 Apr. 10); U.S. patent application publication US2013/0101781 A1 to Lee et al. (2013 Apr. 25); and U.S. patent application publication US 2016/0249685 to Blasi (2016 Sep. 1). Blasi also discloses that the wrapping strands may include silver fibers.

The prior art includes examples of multi-layered fire-resistant fabrics. U.S. patent application publication US2006/064136 to Chiantese (2006 Nov. 23) describes a two-layer composite knitted fabric, possibly being double-faced, having a first layer made of pre-oxidised carbon fiber and a second layer made of a para-aramid fiber and in which the two fibers are combined by the "vanisé" or "Façon metier" techniques. However, Chiantese does not illustrate the fabric. The construction (including in particular, the distribution of oxidised carbon fiber and the para-aramid fiber on the opposing sides of the fabric) resulting from combining the fibers by the "vanisé" or "Façon metier" techniques is unclear. U.S. Pat. No. 5,727,401 to Statham (1998 Mar. 17) describes a 3-end knit fabric. The fabric has stitch yarns and tie yarns that form the face side of the fabric, and nap yarns that are tied at periodic locations by the tie yarns along the back side of the fabric. The stitch yarns, tie yarns, and the nap yarns are made of a fibrous flame resistant material. This fabric is used as a somewhat thick thermal barrier in firefighter's turnout gear.

Accordingly, there remains a need for improved fire-resistant fabrics, which are comfortable to wear, and economical to produce. Preferably, such fabrics are also resistant to bacterial growth.

SUMMARY OF THE INVENTION

In one aspect, the present invention comprises a double-faced fabric of knitted construction. The fabric comprises a first layer comprising a first outward-facing surface of the fabric comprising a first yarn comprising first inherently fire-resistant fibers. The fabric further comprises a second layer comprising a second outward-facing surface of the fabric comprising a second yarn comprising second FR viscose fibers. The first layer and the second layer are attached to each other by interlocking relationship between the first yarn and the second yarn. As the first yarn and the second yarn differ in composition of their fire-resistant fibers or other fibers, this allows the first outward-facing surface and the second-outward facing surface to have different fabric handle and other properties.

In one embodiment of the double-faced fabric, the first yarn is knitted in a series of loops stitched in the plane of the first outward facing surface but not in the plane of the second outward facing surface, except for an optional first interval interlocking stitch separating adjacent intervals of the series of loops of the first yarn, and interlocking the first yarn with the second layer. The second yarn is knitted in a series of loops stitched in the plane of the second outward facing surface but not in the plane first outward facing surface except for an optional second interval interlocking stitch separating adjacent intervals of the series of loops of the second yarn, and interlocking the second yarn with the first layer. This stitching results in the first yarn being substantially entirely or entirely dedicated to the first outward facing surface, and the second yarn being substantially entirely or entirely dedicated to the second outward facing surface, thus "isolating" the properties of the first and second yarns to the first and second outward facing surfaces, respectively.

In one embodiment of the double-faced fabric, the first layer and the second layer are not separated by any intermediate layer between them.

In one embodiment of the double-faced fabric, the first inherently fire-resistant fibers comprise one or a combination of aramid fibers or first fibers that comprise a copolymer of aramid compounds. The aramid fibers may comprise polyarnide-imide fibers.

In one embodiment of the double-faced fabric, the first inherently fire-resistant fibers are present in an amount of 50% to 100% by weight of the first yarn.

In one embodiment of the double-faced fabric, the first yarn is a first blended fiber yarn and further comprises first FR viscose fibers. The first FR viscose fibers may be present in an amount of 0% to 80% by weight of the first yarn.

In one embodiment of the double-faced fabric, the first yarn is a first blended fiber yarn that further comprises first elastane fibers. In one embodiment, the first elastane fibers may be present in an amount from up to 15% by weight of the first yarn. More particularly, the first elastane fibers may present are present in an amount up to 4% by weight of the first yarn. In one embodiment of the fabric, the first blended yarn is a first core spun yarn comprising a first core strand comprising the first elastane fibers, wrapped by first staple strands comprising the first inherently fire-resistant fibers.

In one embodiment of the double-faced fabric, the second yarn is a second blended fiber yarn that further comprises second elastane fibers. In one embodiment, the second elastane fibers may be present in an amount from up to 15% by weight of the second yarn. More particularly, the second elastane fibers may be present in an amount from up to 4% by weight of the second yarn. In one embodiment of the fabric, the second blended yarn is a second core spun yarn comprising a second core strand comprising the second elastane fibers, wrapped by second staple strands comprising the second FR viscose fibers.

In one embodiment of the double-faced fabric, the second yarn is a second blended yarn that further comprises cellulosic-derived fibers, other than the FR viscose fibers, and synthetic inherently fire-resistant fibers. The cellulosic-derived fibers may be regenerated cellulosic fiber (i.e., fibers made of cellulose material that has been converted to a soluble cellulosic derivative, and regenerated as a fiber by spinning or casting). The synthetic fire-resistant fibers may comprise one or a combination of aramid, modracrylic, and polyarnide-imide fibers.

In one embodiment of the double-faced fabric, the second yarn is a second blended yarn that further comprises antibacterial fibers.

BRIEF DESCRIPTION OF THE DRAWINGS

In the drawings shown in the specification, like elements may be assigned like reference numerals. The drawings are not necessarily to scale, with the emphasis instead placed upon the principles of the present invention. Additionally, each of the embodiments depicted are but one of a number of possible arrangements utilizing the fundamental concepts of the present invention.

DETAILED DESCRIPTION OF EMBODIMENTS OF THE INVENTION

Definitions

Figure 1:
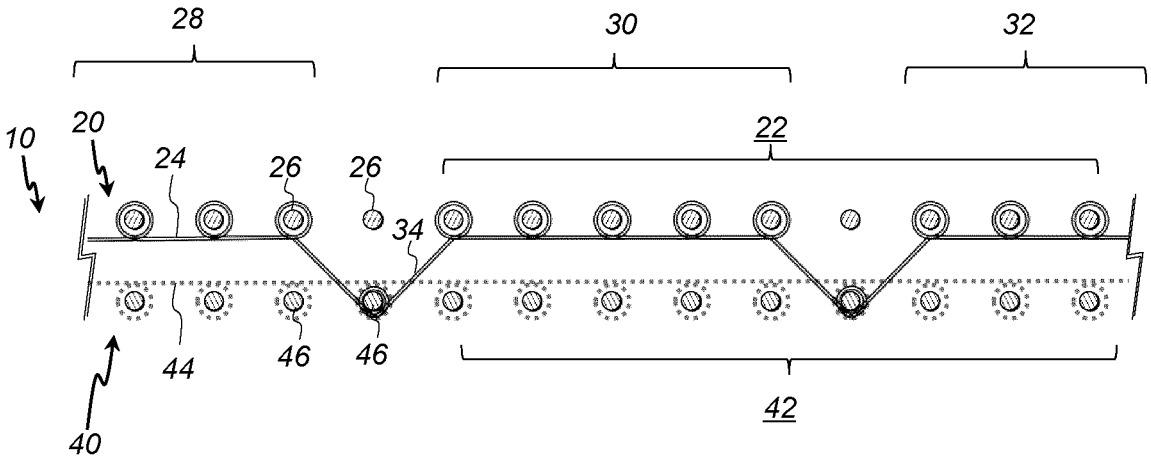
FIG. 1 shows a cross-sectional view of a single course of an embodiment of a fabric of knitted construction of the present invention, in relation to needles of a knitting machine.

Any term or expression not expressly defined herein shall have its commonly accepted definition understood by a person skilled in the art. As used herein, the following terms have the following meanings.

"Fabric" refers to a flexible material having a sheet-form comprising a network of yarns.

"Yarn" refers to an elongate strand of interlocked fibers, suitable for use in the production of fabric. Yarn includes strand spun yarn and core spun yarn.

"Blended yarn" refers to yarn comprising fibers of two or more different compositions.

"Aramid fiber" refers to a type of inherently fire-resistant fiber that comprises an aromatic polyarnide. A non-limiting example of aramid fiber includes polyarnide-imide fiber, or copolymer of aramid compounds, marketed under the trade-name Kermel™ (Kermel S.A.; Colmar, France). Other-non-limiting examples of aramid fibers include para-aramid fibers such as marketed under the trade-name Kevlar™ (DuPont; Wilmington, Delaware, USA), and meta-aramid fibers such as marketed under the trade-name Nomex™ (DuPont; Wilmington, Delaware, USA).

"Elastane fiber" refers to an elastic polyurethane-based fiber. Non-limiting examples of elastane include fibers marketed under the trade-names Spandex™ and Lycra™ (DuPont; Wilmington, Delaware, USA).

"FR viscose fiber" refers to a regenerated cellulosic fiber with an incorporated fire-resistant additive agent or particle. Non-limiting examples of the fire-resistant additive may include phosphorous-based flame retardants, as known in the art. Non-limiting examples of FR viscose fiber include fiber marketed under the trade-name Lenzing FR Viscose™ (Lenzing Aktiengesellschaft; Lenzing, Austria).

"Inherently fire-resistant fiber" refers to a fiber that comprises a fire-resistant material in its chemical structure, such that the fiber itself is non-flammable, without the need for any additive to the fiber. Non-limiting examples of inherently fire-resistant fiber include para-aramid fiber (e.g., Kevlar™, Twaron™, Technora™), meta-aramid fiber (e.g., Nomex™, Conex~) polyarnide-imide fiber (e.g., Kermel™) melamine fiber (e.g., Basofil™) modacrylic fiber, oxidized poly(acrylonitrile) fiber (e.g., Panox™, Pyromex™) polybenzimidazole (PBI), polyimide (e.g., P84™), and polybenzoxazole (PBO) (e.g., Zylon™).

"Antibacterial fiber" refers to fiber with an embedded or surface-attached agent that interferes with growth and/or reproduction of bacteria. Non-limiting examples of such agents include silver ions or compounds (e.g., silver nanoparticles), quaternary ammonium ions or compounds, Triclosan (5-Chloro-2-(2,4-dichlorophenoxy)phenol), metallic salts such as zinc oxide or titanium dioxide, Chitosan ((1,4)-2-Amino-2-desoxy-beta-D-glucan), cyclodextrins, an N-halamine polymer, and combinations of the foregoing. A non-limiting example of antibacterial fiber is an active version of regenerated cellulosic fiber marketed under the trade-name smartcel Sensitive™ (Smartfiber AG; Rudolstadt, Germany), which comprises zinc oxide.

Double-Faced Fabric

FIG. 1 shows a cross-sectional view of a single course of an embodiment of a double-faced fabric (10) of the present invention. FIG. 1 shows the fabric (10) at an enlarged scale with exaggerated spacing between its constituent yarns for enhanced visibility of the structure of the fabric (10).

Figure 2:
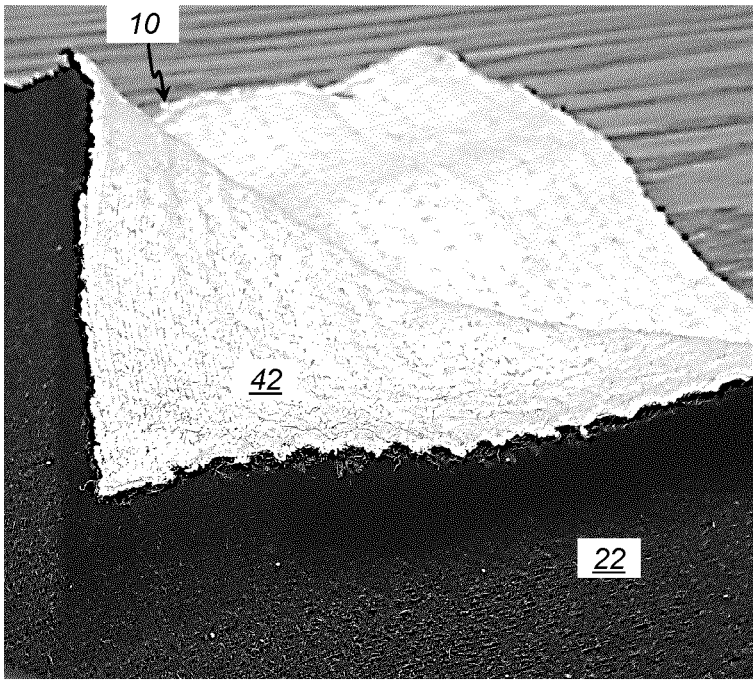
FIG. 2 shows a photograph of an embodiment of a fabric of the present invention.

In the embodiment shown in FIG. 1, the fabric (10) includes a first layer (20) and a second layer (40). In the description that follows terms "first" and "second" are used only in a nominal sense for convenience to differentiate between their layers, the outward-facing surfaces formed by them, and their constituent yarns. The first layer (20) includes a first outward-facing surface (22) of the fabric (10), while the second layer (40) includes a second outward-facing surface (42) of the fabric (10). The first outward-facing surface (22) of the fabric (10) and the second outward-facing surface (42) of the fabric (10) include a first blended yarn (24) and a second blended yarn (44), respectively. In an exemplary use of the fabric (10), the first outward-facing surface (22) forms an outer surface of a garment facing away from the wearer, while the second outward-facing surface (42) forms the inner surface of the garment in contact with the wearer's skin. As described below, the first blended yarn (24) and the second blended yarn (44) differ in composition of their fire-resistant fibers or other fibers, thereby allowing the first outward-facing surface (22) and the second-outward facing surface to have different fabric handle and other properties. FIG. 2 shows an embodiment of a fabric (10) made in accordance with the structure shown in FIG. 1. In FIG. 2, the fabric is folded back onto itself to show both the first outward-facing surface (22) (dark grey) and the second outward-facing surface (42) (white), and the thickness of the fabric (10). It will be noted that in this embodiment, the fabric is relatively thin with a thickness on the order of about 2 mm to about 4 mm.

The fabric (10) is of knitted construction. As such, the first layer (20) and the second layer (40) are attached to each other by interlocking relationship between the first blended yarn (24) and the second blended yarn (44). As such, no adhesive is needed between the first layer (20) and the second layer (40), which allows avoiding adversely affecting the suppleness of the fabric (10).

FIG. 1 shows a cross-sectional view of a single course of an embodiment of the knitted construction of the fabric (10), illustrated using conventional symbols known to persons skilled in the art of knitting. As known to persons skilled in the art of knitting, a "course" refers to the meandering path of a yarn. It will be understood that the single course forms part of a "wale"—i.e., the course is securely suspended from other like courses by passage of loops of yarn through stitches—so that it is part of larger piece of two-dimensional fabric. This embodiment is more particularly of weft knitted construction in which the first blended yarn (24) and the second blended yarn (44) run across the width of the fabric. In FIG. 1, the points (26) collectively represent a first bed of needles, such as found in a knitting machine. The points (46) collectively represent a second bed of needles in cross-section, such as found in a knitting machine. For convenience of description, the first outward-facing surface (22) and the second outward facing surface (42) are considered herein to be the front side and the back side of the fabric (10), respectively. In the first layer (20), the first blended yarn (24) forms a plurality of intervals (28, 30, 32) of five "loop stitched to front" stitches, with each pair of adjacent intervals separated by a first "tuck stitch" or first "interval interlocking stitch" (34) to the second layer (40). (The number of loops in each interval (28, 30, 32) may be different in other embodiments. As non-limiting examples, in some embodiments the number of loops in each interval (28, 30, 32) may be two, three, four, five, six, seven, eight, nine, ten, or more than ten loops.) By virtue of this first tuck stitch (34), the first blended yarn (24) and the second blended yarn (44) are in interlocking relationship with each other, whether directly or indirectly. In the second layer (40), the second blended yarn (44) forms a series of "loop stitched to back" stitches. It will be appreciated that a second "tuck stitch" or second "interval interlocking stitch" (not shown) of the second blended yarn (44) to the first layer (20) (analogous to the first tuck stitch (34)) may be used in alternative to, or in addition to the first tuck stitch (34). In the embodiment shown in FIG. 1, it will be noted that the first blended yarn (24) is loop stitched in the plane of the first outward facing surface (22), but not in the plane of the second outward facing surface (42), except for the first interval interlocking stitch (34), so that the first blended yarn (24) forms substantially no part, or no part at all, of the second outward-facing surface (42), such that the first blended yarn (24) has no material effect on the fabric handle or other properties of the second outward-facing surface (42). Likewise, the second blended yarn (44) is loop stitched in the plane of the second outward facing surface (42), but not in the plane of the first outward facing surface (22), so that the second blended yarn (44) forms substantially no part, or no part at all, of the first outward-facing surface (22), such that the second blended yarn (44) has no material effect on the fabric handle or other properties of the first outward-facing surface (22). Also, it will be noted that the first layer (20) and the second layer (40) are not separated by any intermediate layer between them. The absence of any intermediate layer may help to maintain the suppleness of the fabric (10).

Apparatus and methods for producing double-faced fabrics of knitted construction, are known to persons skilled in the art of textile manufacture, and do not themselves form part of the claimed invention. The present invention is not limited by any particular configuration of knit pattern unless so expressed in the claims. The person skilled in the art may select an appropriate parameters such as knit patterns, and tautness of the yarns, to achieve desired mechanical properties of the fabric (10) such as elasticity and porosity.

The fabric (10) may be dyed to a desired color, and subjected to other finishing treatments, to arrive a finished textile product.

First Blended Yarn

In one embodiment, the first blended yarn (24) includes first inherently fire-resistant fibers and first elastane fibers. In one embodiment, the first blended yarn (24) is a first core spun yarn having a first core strand that includes the elastane fibers, wrapped by first staple fibers that include the inherently fire-resistant fibers. In other embodiments, the first fire-resistant fibers and first elastane fibers may be spun together in ways, as known to persons skilled in the art of yarn production.

The first elastane fibers impart elasticity to the first layer (20) of the fabric (10). The amounts of first elastane fibers may be selected by persons skilled in the art so that the first layer (20) of the fabric (10) has a desired fire-resistance and elasticity. In one embodiment, the first elastane fibers are present in an amount from up to 15% by weight of the first yarn (24), and more particularly from up to 4% by weight of the first blended yarn (24).

The first inherently fire-resistant fibers impart fire-resistance to the first layer (20) of the fabric (10). In one embodiment, the first fire-resistant fibers may also include first FR viscose fibers, such that the first blended yarn (24) has a combination of first aramid fibers and first FR viscose fibers. A suitable example of aramid fiber may be Kermel™ (Kermel S.A.; Colmar, France), having regard to its suppleness, and low modulus of elasticity. In comparison with other inherently fire-resistant fibers, Kermel™ has a relatively high flexibility, in comparison with other aramid-based fibers such as Kevlar™ or Nomex™. A suitable example of FR viscose fiber is Lenzing FR Viscose™ (Lenzing Aktiengesellschaft; Lenzing, Austria). The relative amounts of the first aramid fibers and the first FR viscose fibers may be selected by the person skilled in the art having regard to factors including the desired fire-resistance and cost of the first blended yarn (24). Aramid fibers are generally more fire-resistant, but more expensive, than FR viscose fibers. In embodiments, the aramid fibers may be present in an amount ranging from 50% to 100% by weight of the first blended yarn (24), while the first FR viscose fibers may be present in an amount ranging from up to 50% by weight of the first blended yarn (24).

Second Blended Yarn

In one embodiment, the second blended yarn (44) includes second FR viscose fibers and second elastane fibers, and possibly other types of second fibers. In one embodiment, the second blended yarn (44) is a second core spun yarn having a second core strand that includes the elastane fibers, wrapped by second staple fibers that include the second FR viscose fibers, and any other types of second fibers, if present. In other embodiments, the second fire-resistant fibers and second elastane fibers may be spun together in ways, as known to persons skilled in the art of yarn production.

The second elastane fibers impart elasticity to the second layer (40) of the fabric (10). The amounts of second elastane fibers may be selected by persons skilled in the art so that the second layer (40) of the fabric (10) has a desired fire-resistance and elasticity. In one embodiment, the second elastane fibers may be present in an amount from 0% to 15% by weight of the second yarn (44), and more particularly from 0% to 4% by weight of the second blended yarn (44).

The second FR viscose fibers impart fire-resistance to the second layer (40) of the fabric (10). A suitable example of FR viscose fiber is Lenzing FR Viscose™ (Lenzing Aktiengesellschaft; Lenzing, Austria). In one embodiment, the second blended yarn (44) may have no inherently fire-resistant fibers or a lesser weight percentage of inherently fire-resistant fibers in comparison with the first blended yarn (24). This allows for economical and effective distribution of generally more expensive and more fire-resistant inherently fire-resistant fibers to the first outward-facing surface (22) of the fabric (10), which may be used as an outer surface of a garment. It being appreciated that FR viscose fibers generally produce fabrics having a softer fabric handle than inherently fire-resistant fibers, this also allows for the second outward-facing surface (42) of the fabric (10) to have a softer fabric handle, which may be advantageous where the second outward-facing surface (42) of the fabric (10) is used as the inner surface of a garment.

In one embodiment, the other second fibers may include additional cellulosic-derived fibers (other than the FR viscose fibers), such as regenerated cellulosic fibers. The other cellulosic-derived fiber may enhance the fabric handle of the second outward-facing surface (42) of the fabric (10), which may be advantageous when used as the inner side of a garment. They may also provide additional functionalities such as antibacterial and UV protection. A suitable example of a cellulosic-derived fiber is smartcel sensitive Fiber™ (Smartfiber AG; Rudolstadt, Germany).

In one embodiment, the other second fibers may include synthetic fire-resistant fibers, such as aramid, modacrylic, and polyarnide-imide fibers.

In one embodiment, the other second fibers may include antibacterial fiber that may enhance the anti-bacterial properties of the second outward-facing surface (42) of the fabric (10), which is advantageous when used as the inner side of a garment. A suitable example of an antibacterial fiber is smartcel Sensitive™ (Smartfiber AG; Rudolstadt, Germany), which comprises zinc oxide particles. In addition to acting as antibacterial agents, the zinc oxide particles may also shield against UV radiation.

Further Embodiment of Blended Fabric and Yarns

Figure 3:
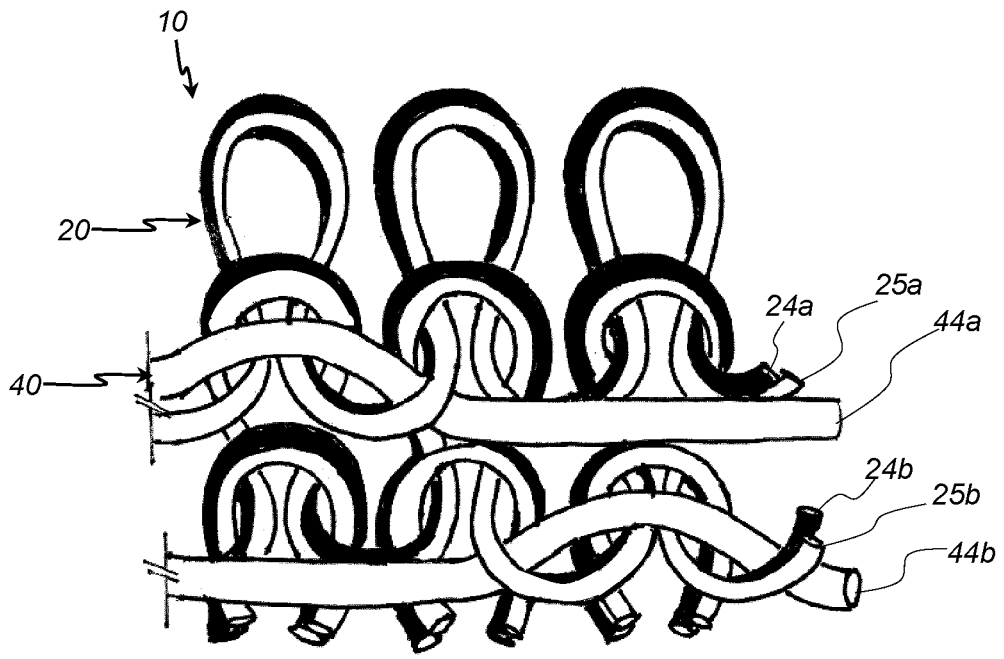
FIG. 3 shows a plan schematic view of another embodiment of a fabric of knitted construction of the present invention.

FIG. 3 shows a plan schematic view of another embodiment of a fabric (10) of knitted construction, in accordance with the present invention. In this embodiment, the fabric (10) has a three-thread fleece knitted structure, as disclosed in Badr, A. A., & El-Nahrawy, A. (2016), "Moisture properties of raised 3-thread fleece fabric knitted with different face and fleecy yarns", Alexandria Engineering Journal, 55(3), 2881-2892. In this fabric (10): the first blended yarn (24*a*, 24*b*) is a "face yarn" that forms the outer first layer (20) of the fabric (10); the second blended yarn (44*a*, 44*b*) is a "fleecy yarn" that forms the inner second layer (40) of the fabric (10); the third yarn (25*a*, 25*b*) is a "binding yarn" that connects the first layer (20) and the second layer (40) in such manner that the second blended yarn (44*a*, 44*b*) is not exposed on the first layer (20) of the fabric (10). Each of the yarns (24, 25, 44) may comprise various types of yarn structures, such as a corn-spun yarn structure. For example, each of the first blended yarn (24) ("face yarn") and the third yarn (25) ("binding yarn") may comprise a core strand of elastane fibers, wrapped by staple strands of mainly inherently fire-resistant fibers. The second blended yarn (44) ("fleecy yarn") comprises FR viscose fibers to enhance the comfort of the second layer (40) of the fabric (10). These FR viscose fibers may be blended with inherently fire-resistant fibers to enhance fire resistance of the second blended yarn (44), and with elastane fibers to enhance elasticity of the second blended yarn (44). The FR viscose fibers may be an antibacterial fiber by augmentation with one or a combination of exemplary agents (e.g., agents as described in the above definition of "antibacterial fiber"), which may also enhance the UV shielding effect of the fabric (10).

INTERPRETATION

The corresponding structures, materials, acts, and equivalents of all means or steps plus function elements in the claims appended to this specification are intended to include any structure, material, or act for performing the function in combination with other claimed elements as specifically claimed.

References in the specification to "one embodiment", "an embodiment", etc., indicate that the embodiment described may include a particular aspect, feature, structure, or characteristic, but not every embodiment necessarily includes that aspect, feature, structure, or characteristic. Moreover, such phrases may, but do not necessarily, refer to the same embodiment referred to in other portions of the specification. Further, when a particular aspect, feature, structure, or characteristic is described in connection with an embodiment, it is within the knowledge of one skilled in the art to affect or connect such module, aspect, feature, structure, or characteristic with other embodiments, whether or not explicitly described. In other words, any module, element or feature may be combined with any other element or feature in different embodiments, unless there is an obvious or inherent incompatibility, or it is specifically excluded.

It is further noted that the claims may be drafted to exclude any optional element. As such, this statement is intended to serve as antecedent basis for the use of exclusive terminology, such as "solely," "only," and the like, in connection with the recitation of claim elements or use of a "negative" limitation. The terms "preferably," "preferred," "prefer," "optionally," "may," and similar terms are used to indicate that an item, condition or step being referred to is an optional (not required) feature of the invention.

The singular forms "a," "an," and "the" include the plural reference unless the context clearly dictates otherwise. The term "and/or" means any one of the items, any combination of the items, or all of the items with which this term is associated. The phrase "one or more" is readily understood by one of skill in the art, particularly when read in context of its usage.

The term "about" can refer to a variation of ±5%, ±10%, ±20%, or ±25% of the value specified. For example, "about 50" percent can in some embodiments carry a variation from 45 to 55 percent. For integer ranges, the term "about" can include one or two integers greater than and/or less than a recited integer at each end of the range. Unless indicated otherwise herein, the term "about" is intended to include values and ranges proximate to the recited range that are equivalent in terms of the functionality of the composition, or the embodiment.

As will be understood by one skilled in the art, for any and all purposes, particularly in terms of providing a written description, all ranges recited herein also encompass any and all possible sub-ranges and combinations of sub-ranges thereof, as well as the individual values making up the range, particularly integer values. A recited range includes each specific value, integer, decimal, or identity within the range. Any listed range can be easily recognized as sufficiently describing and enabling the same range being broken down into at least equal halves, thirds, quarters, fifths, or tenths. As a non-limiting example, each range discussed herein can be readily broken down into a lower third, middle third and upper third, etc.

As will also be understood by one skilled in the art, all language such as "up to", "at least", "greater than", "less than", "more than", "or more", and the like, include the number recited and such terms refer to ranges that can be subsequently broken down into sub-ranges as discussed above. In the same manner, all ratios recited herein also include all sub-ratios falling within the broader ratio.

The invention claimed is:

1. A double-faced fabric of knitted construction, the fabric comprising:

(a) a first layer comprising a first outward-facing surface of the fabric comprising a first yarn comprising first inherently fire-resistant fibers; and (b) a second layer comprising a second outward-facing surface of the fabric comprising a second yarn comprising second FR viscose fibers, wherein the first layer and the second layer are attached to each other by interlocking relationship between the first yarn and the second yarn, and wherein, (a) the first yarn is knitted in a series of loops stitched in the direction of the first outward facing surface but not in the plane of the second outward facing surface except for an optional first interval interlocking stitch separating adjacent intervals of the series of loops of the first yarn, and interlocking the first yarn with the second layer, and (b) the second yarn is knitted in a series of loops stitched in the plane of the second outward facing surface but not in the plane of the first outward facing surface except for an optional second interval interlocking stitch separating adjacent intervals of the series of loops of the second yarn, and interlocking the second yarn with the first layer.

2. The double-faced fabric of claim 1, wherein the fabric comprises the optional first interval interlocking stitch.

3. The double-faced fabric of claim 1, wherein the fabric comprises the optional second interval interlocking stitch.

4. The double-faced fabric of claim 1, wherein the first layer and the second layer are not separated by any intermediate layer between them.

5. The double-faced fabric of claim 1, wherein the first inherently fire-resistant fibers comprise one or combination of first aramid fibers or first fibers that comprise a copolymer of aramid compounds.

6. The double-faced fabric of claim 1, wherein the first inherently fire-resistant fibers comprise polyarnide-imide fibers.

7. The double-faced fabric of claim 1, wherein the first inherently fire-resistant fibers are present in an amount from 50% to 100% by weight of the first yarn.

8. The double-faced fabric of claim 1, wherein the first yarn is a first blended yarn that further comprises first FR viscose fibers.

9. The double-faced fabric of claim 5, wherein the first FR viscose fibers are present in an amount from up to 50% by weight of the first yarn.

10. The double-faced fabric of claim 1, wherein the first yarn is a first blended yarn that further comprises first elastane fibers present in an amount up to 15% by weight of the first blended yarn.

11. The double-faced fabric of claim 10, wherein the first blended yarn is a first core spun yarn comprising a first core strand comprising the first elastane fibers, wrapped by first staple strands comprising the first inherently fire-resistant fibers.

12. The double-faced fabric of claim 1, wherein the second yarn is a second blended yarn comprising second elastane fibers present in an amount up to 15% by weight of the second blended yarn.

13. The double-faced fabric of claim 12, wherein the second blended yarn is a second core spun yarn comprising a second core strand comprising the second elastane fibers, wrapped by second staple strands comprising the second FR viscose fibers.

14. The double-faced fabric of claim 1, wherein the second yarn is a second blended yarn that further comprises cellulosic-derived fibers, other than the FR viscose fibers.

15. The double-faced fabric of claim 1, wherein the second yarn contains synthetic fire-resistant fibers comprising one or a combination of aramid, modacrylic, and polyarnide-imide fibers.

16. The double-faced fabric of claim 14, wherein the cellulosic-derived fibers comprise regenerated cellulosic fibers.

17. The double-faced fabric of claim 1, wherein the second yarn is a second blended yarn that further comprises anti-bacterial fibers.

18. The double-faced fabric of claim 1, wherein the first yarn and the second yarn are connected by a third yarn to form a three-thread fleece knitted structure, wherein the third yarn comprises inherently fire-resistant fibers.

* * * * *